US006546591B2

(12) United States Patent
Onuma et al.

(10) Patent No.: US 6,546,591 B2
(45) Date of Patent: Apr. 15, 2003

(54) PRESSURE PAD AND CYLINDER CLEANING APPARATUS

(75) Inventors: Hiraku Onuma, Yokohama (JP); Tomokatsu Mukae, Tokyo (JP); Takayuku Goto, Yamakawa-machi (JP)

(73) Assignee: Baldwin-Japan, Ltd., Tokyo (JP)

( * ) Notice: Subject to any disclaimer, the term of this patent is extended or adjusted under 35 U.S.C. 154(b) by 0 days.

(21) Appl. No.: 09/894,534

(22) Filed: Jun. 28, 2001

(65) Prior Publication Data

US 2001/0037535 A1 Nov. 8, 2001

Related U.S. Application Data

(63) Continuation of application No. 09/246,455, filed on Feb. 9, 1999, now Pat. No. 6,253,413.

(30) Foreign Application Priority Data

Feb. 10, 1998 (JP) ..... 10-044417

(51) Int. Cl.[7] ..... B41F 35/06
(52) U.S. Cl. ..... 15/256.51; 101/425; 399/352
(58) Field of Search ..... 15/256.51; 101/425; 399/352; 100/174; 118/203; 162/199, 272

(56) References Cited

U.S. PATENT DOCUMENTS

| | | | | | |
|---|---|---|---|---|---|
| 4,344,361 | A | * | 8/1982 | MacPhee et al. | 101/425 |
| 4,755,252 | A | * | 7/1988 | Held | 15/256.51 X |
| 4,920,880 | A | * | 5/1990 | Hara et al. | 101/425 |
| 4,986,182 | A | * | 1/1991 | Sawaguchi et al. | 15/256.51 X |
| 5,069,128 | A | * | 12/1991 | Hara et al. | 15/256.51 X |
| 5,074,211 | A | * | 12/1991 | Loos et al. | 15/256.51 X |
| 5,117,754 | A | * | 6/1992 | Nozaka et al. | 15/256.51 X |
| 5,125,342 | A | * | 6/1992 | Hara | 15/256.51 X |
| 5,271,326 | A | * | 12/1993 | Ebina | 101/425 |
| 5,282,420 | A | * | 2/1994 | Hara et al. | 15/256.51 X |
| 5,404,819 | A | * | 4/1995 | Hishinuma et al. | 15/256.51 X |
| 5,461,977 | A | | 10/1995 | Germann | 101/137 |
| 5,519,914 | A | * | 5/1996 | Egan | 101/425 X |

FOREIGN PATENT DOCUMENTS

| | | | |
|---|---|---|---|
| CN | 1128212 A | | 8/1996 |
| EP | 696504 | * | 2/1996 |
| EP | 0 816 079 A2 | | 1/1998 |

OTHER PUBLICATIONS

Patent Abstracts of Japan, vol. 98, No. 14, Dec. 31, 1998.*
Patent Abstracts of Japan, vol. 18, No. 452, Aug. 23, 1994.*

* cited by examiner

*Primary Examiner*—Mark Spisich
(74) *Attorney, Agent, or Firm*—Morgan & Finnegan, LLP

(57) ABSTRACT

There is disclosed a pressure pad used in an apparatus for cleaning the outer surface of a cylinder with a cleaning fabric. The cleaning fabric is directed between the pressure pad and the cylinder, the pressure pad having opposite side edges which are fixed in the apparatus to extend parallel to the cylinder. The pressure pad is made of elastomer and curved between the opposite side edges thereof to be convex toward the outer surface of the cylinder. The pressure pad cooperates with the cleaning fabric so that the cleaning fabric can be pressed against the outer surface of the cylinder by the pressure pad to clean the outer surface of the cylinder. The pressure pad comprises an engaged portion engaged with the cleaning fabric so that the cleaning fabric is sandwiched between the engaged portion and the cylinder to be pressed against the outer surface of the cylinder. The pressure pad further comprises a pressure imparting portion positioned between the engaged portion and at least one of the opposite side edges of the pressure pad for imparting a pressure between the engaged portion and the cylinder. The pressure imparting portion is different in mechanical parameter from the engaged portion.

12 Claims, 6 Drawing Sheets

PRESSURE PAD AND CYLINDER CLEANING APPARATUS

This is a continuation of application Ser. No. 09/246,455 filed Feb. 9, 1999, U.S. Pat. No. 6,253,413.

BACKGROUND OF THE INVENTION

1. Field of the Invention

The invention relates to an apparatus for cleaning the outer surface of a cylinder with a cleaning fabric in an offset printing press. The cylinder may be a blanket cylinder, plate cylinder, inking roller and the like. In particular, the invention relates to a pressure pad used in the apparatus. The cleaning fabric is pressed against the outer surface of the cylinder by the pressure pad to clean the outer surface of the cylinder. In addition, the apparatus includes main members shaped by metal plate working.

2. Description of Related Art

There has been proposed an apparatus for cleaning the outer surface of a cylinder with a cleaning fabric in an offset printing press, as disclosed in Japanese Laid-Open Patent Publications No. 250,046 of 1998 and No. 143,545 of 1994. The cleaning fabric is directed between a pressure pad and the cylinder. The pressure pad has opposite side edges which are disposed in the apparatus to extend parallel to the cylinder. The pressure pad is made of elastomer to be constant in thickness and rigidness throughout the length and width thereof. In addition, the pressure pad takes the form of an arch which is curved between the opposite side edges thereof to be convex toward the outer surface of the cylinder. The pressure pad cooperates with the cleaning fabric so that the cleaning fabric can be pressed against the outer surface of the cylinder by the pressure pad when the cylinder is rotated, to clean the outer surface of the cylinder.

However, as to a blanket cylinder in the offset printing press, the cylinder includes a gap formed between the opposite ends of a blanket which is wound around the cylinder. The pressure pad is therefore subject to a shock caused by the gap of the cylinder whenever the gap reaches the pressure pad, resulting in noise and vibration, even if the cylinder is rotated at a low speed of about 8 rpm. The noise and vibration are gradually increased in proportion to the rotating speed of the cylinder. The noise and vibration are extremely increased to be unacceptable when the cylinder is rotated at a high speed of about 70 rpm.

There has been also proposed an apparatus including an air pad or expandable bladder, as disclosed in U.S. Pat. No. 4,344,361. In the apparatus, the noise and vibration can be decreased by the air pad. However, the air pad involves a source of air, piping, control of air and the like to be complicated and expensive.

In addition, the apparatus generally includes a support bar to which the opposite side edges of the pressure pad are fixed. A pair of side plates are spaced from and opposed to each other. The support bar extends between the side plates to be mounted directly or indirectly on the side plates for supporting the pressure pad. In the case, it is required to remove the assembly including the support bar, the side plates and the like from adapter plates which are mounted on fixed frame means, occasionally for maintenance. It is also required to then set again the assembly on the adapter plates. However, the support bar has been machined to be rigid, so as not to amplify the noise and vibration of the pressure pad. In this connection, the support bar is considerably heavy. It is therefore troublesome to remove and then set again the assembly, taking labour and time.

It is therefore an object of the invention to provide a new and improved pressure pad used in an apparatus for cleaning the outer surface of a cylinder with a cleaning fabric, to thereby overcome the above problems.

Another object of the invention is to provide the pressure pad in which the cleaning fabric can be conveniently pressed against the outer surface of the cylinder by the pressure pad without being complicated and expense, to clean the outer surface of the cylinder.

Other object of the invention is to provide the pressure pad in which the noise and vibration can be effectively decreased to be acceptable not only when the cylinder is rotated at a low speed but also when it is rotated at a high speed.

Other object of the invention is to provide the apparatus including a support bar to which the opposite side edges of the pressure pad are fixed, the support bar being rigid so as not to amplify the noise and the vibration of the pressure pad.

Other object of the invention is to provide the apparatus in which the support bar is relatively light to remove and then set again the assembly including the support bar and the like without taking labour and time.

SUMMARY OF THE INVENTION

According to the invention, there is provided a pressure pad used in an apparatus for cleaning the outer surface of a cylinder with a cleaning fabric. The cleaning fabric is directed between the pressure pad and the cylinder, the pressure pad having opposite side edges which are disposed in the apparatus to extend parallel to the cylinder. The pressure pad is made of elastomer and curved between the opposite side edges thereof to be convex toward the outer surface of the cylinder. The pressure pad cooperates with the cleaning fabric so that the cleaning fabric can be pressed against the outer surface of the cylinder by the pressure pad to clean the outer surface of the cylinder.

The pressure pad comprises an engaged portion engaged with the cleaning fabric so that the cleaning fabric is sandwiched between the engaged portion and the cylinder to be pressed against the outer surface of the cylinder. The pressure pad further comprises a pressure imparting portion positioned between the engaged portion and at least one of the opposite side edges of the pressure pad for imparting a pressure between the engaged portion and the cylinder. The pressure imparting portion is different in mechanical parameter from the engaged portion.

The mechanical parameter may comprise the thickness of the pressure pad. In the embodiment, the engaged portion is relatively thin. The pressure imparting portion is relatively thick to be different in thickness from the engaged portion.

The pressure pad may include a central portion intermediate between the opposite side edges of the pressure pad. In addition, the pressure pad may vary in thickness to be more thick toward the opposite side edges from the central portion. In the embodiment, the engaged portion comprises the central portion. The pressure imparting portion comprises the more thick portion positioned between the central portion and at least one of the opposite side edges. The pressure pad may vary in thickness continuously. The pressure pad may vary in thickness discontinuously.

The pressure pad may vary in thickness to be more thick toward one of the opposite side edges of the pressure pad from the other side edge. In the embodiment, the engaged portion comprises a relatively thin portion spaced from the opposite side edges. The pressure imparting portion comprises the more thick portion positioned between the relatively thin portion and one of the opposite side edges. The pressure pad may vary in thickness continuously. The pressure pad may vary in thickness discontinuously.

The mechanical parameter may comprise the rigidness of the pressure pad. In the embodiment, the engaged portion is relatively flexible. The pressure imparting portion is relatively rigid to be different in rigidness from the engaged portion. The pressure imparting portion may include fibers incorporated thereinto to be relatively rigid.

The apparatus may comprise a pair of side plates spaced from and opposed to each other. The apparatus may further comprise a support bar to which the opposite side edges of the pressure pad are fixed. The support bar extends between the side plates to be mounted directly or indirectly on the side plates for supporting the pressure pad. The support bar may comprise a metal plate which includes at least one bend formed by metal plate working.

The apparatus may further comprise a supply of cleaning fabric from which the cleaning fabric is supplied to the pressure pad. Support means may be mounted on the side plates for supporting the supply of cleaning fabric. A take-up shaft may extend between the side plates to be mounted on the side plates for removal, the cleaning fabric being directed to the take-up shaft through the pressure pad. First drive means may be provided for rotating the take-up shaft to take-up the cleaning fabric about the take-up shaft. The apparatus may further comprise adapter plate means mounted on fixed frame means and including guide means for supporting and guiding the side plates for movement toward and from the cylinder. Second drive means may be connected directly or indirectly to the side plates for moving the side plates along the guide means toward and from the cylinder so that the cleaning fabric can be pressed against and retracted from the cylinder.

According to the invention, there is also provided the apparatus in which the support bar extends between the side plates to be mounted directly or indirectly on the side plates for supporting the pressure pad, the support bar comprising the metal plate which includes at least one bend formed by metal plate working.

The pressure pad may comprise an air pad, a sponge pad or an elastomer pad having a constant thickness.

The supply of cleaning fabric may comprise a supply roll including a core about which the cleaning fabric is wound. The supply roll may further include projections projecting from the opposite end surfaces of the supply roll. The support means may Comprise metal plates shaped by metal plate working to include slots into which the projections are received for movement in accordance with the decrease in diameter of the supply roll.

The support means may be integrally fixed to the support bar to be mounted indirectly on the side plates.

The support bar may include a pressure pad support portion for supporting the pressure pad and a supply roll support portion bended from the pressure pad support portion by the bend. The supply roll may have an outer surface engaged with the supply roll support portion to support the supply roll for rotation.

A movable member may be engaged with the outer surface of the supply roll. Resiliently urging means may be provided for resiliently urging the movable member to move it in accordance with the decrease in diameter of the supply roll.

The first drive means may rotate the take-up shaft in response to the second drive means moving the side plates by which the cleaning fabric is pressed against and retracted from the cylinder.

The first drive means may comprise a handle connected to the take-up shaft through a one-way clutch to manually rotate the take-up shaft an angle at a time.

DETAILED DESCRIPTION OF THE PREFERRED EMBODIMENTS

Figure 1:
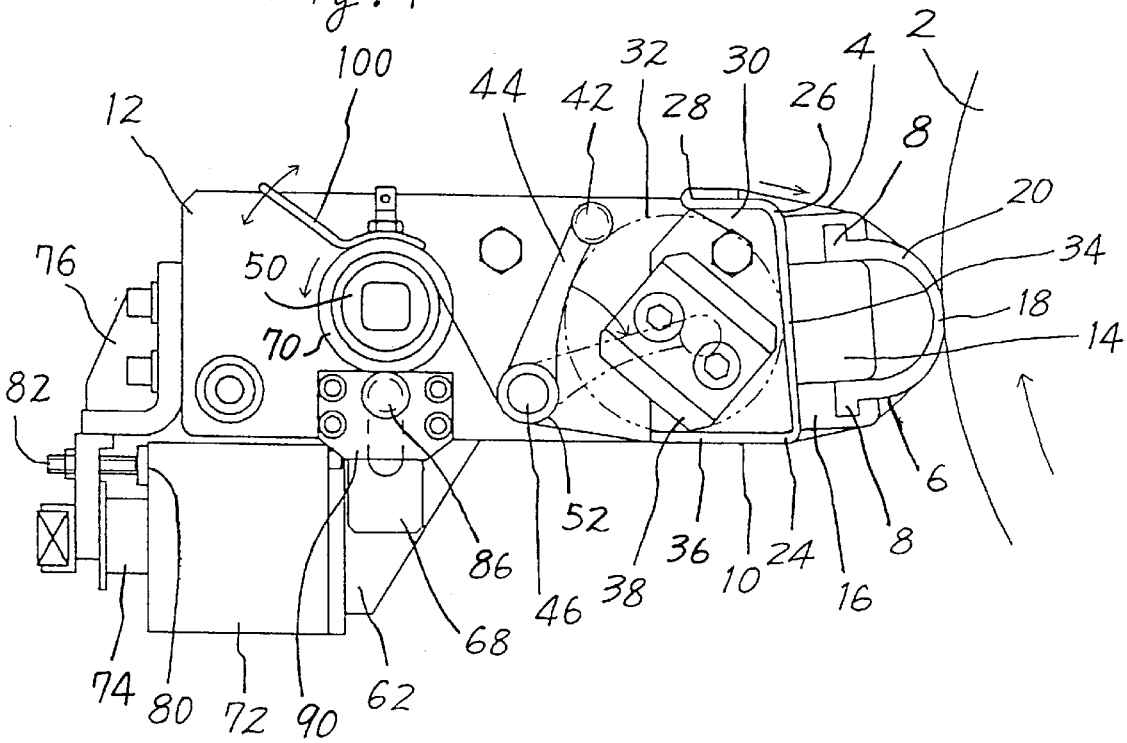
FIG. 1 is a schematic side view of an apparatus for cleaning the outer surface of the cylinder according to the invention.

Turning now to the drawings, FIG. 1 illustrates an apparatus for cleaning the outer surface of a cylinder 2 with a cleaning fabric 4 in an offset printing press. The cleaning fabric 4 is directed between a pressure pad 6 and the cylinder 2. The pressure pad 6 has opposite side edges 8 which are disposed in the apparatus to extend parallel to the cylinder 2. The pressure pad 6 is made of elastomer to take the form of an arch which is curved between the opposite side edges 8 to be convex toward the outer surface of the cylinder 2. The pressure pad 6 cooperates with the cleaning fabric 4 so that the cleaning fabric 4 can be pressed against the outer surface of the cylinder 2 when the cylinder 2 is rotated in a direction indicated by an arrow, to clean the outer surface of the cylinder 2.

Figure 4:
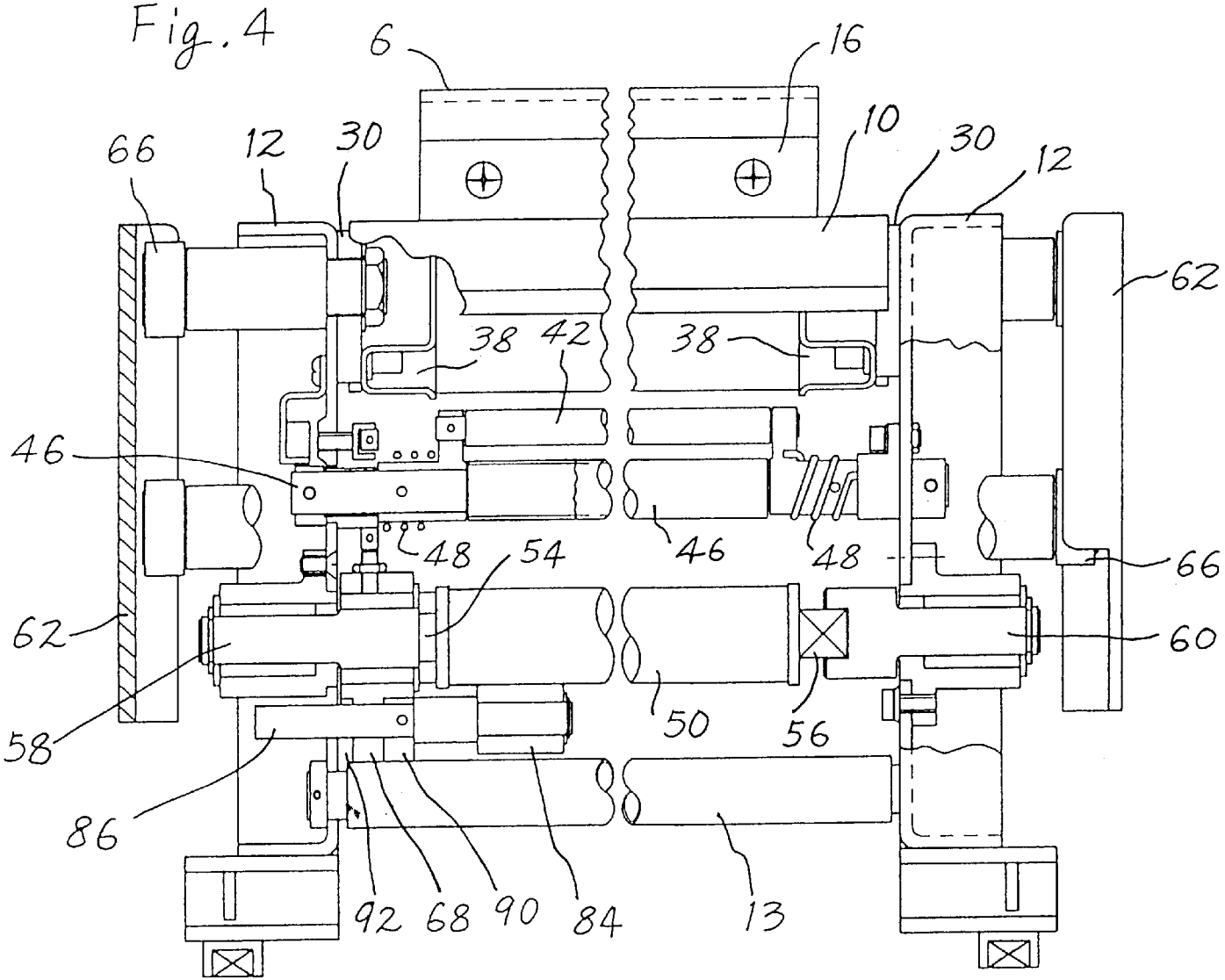
FIG. 4 is a plan and development view of the apparatus of FIG. 1.

In the embodiment, the apparatus includes a-support bar 10 to which the opposite side edges 8 of the pressure pad 6 are fixed. The apparatus further includes a pair of side plates 12 spaced from and opposed to each other. The side plates 12 are shaped by metal plate working such as bending or pressing and connected to each other by a stay 13, as shown in FIG. 4. The support bar 10 extends between the side plates 12 to be mounted directly or indirectly on the side plates 12 for supporting the pressure pad 6. The support bar 10 includes a back up bar 14 fixed thereto to extend between the side plates 12. Clamps 16 are fixed to the back up bar 14 by screws so that the opposite side edges 8 are clamped between the clamps 16 and the back up bar 14 to be fixed to the support bar 10. The pressure pad 6 includes ridges formed along the opposite side edges 8 thereof to be received in channels formed in the clamps 16.

The pressure pad 6 comprises an engaged portion 18 engaged with the cleaning fabric 4 so that the cleaning fabric 4 is sandwiched between the engaged portion 18 and the cylinder 2 to be pressed against the outer surface of the cylinder 2. The pressure pad 6 further comprises a pressure imparting portion 20 positioned between the engaged portion 18 and at least one of the opposite side edges 8 of the pressure pad 6 for imparting a pressure between the engaged portion 18 and the cylinder 2. The pressure imparting portion 20 is different in mechanical parameter from the engaged portion 18.

The mechanical parameter may comprise the thickness of the pressure pad 6. In the embodiment, the engaged portion 18 is relatively thin. The pressure imparting portion 20 is relatively thick to be different in thickness from the engaged portion 18.

Figure 5:
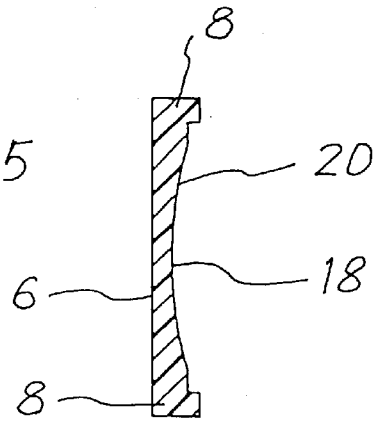
FIG. 5 is a sectional view of the pressure pad of FIG. 1 before fixed.

For example, the pressure pad 6 is formed to be straight before fixed to the support bar 10, as shown in FIG. 5. The pressure pad 6 is then curved between the opposite side edges 8 and fixed to the support bar 10, to be convex toward the outer surface of the cylinder 2. The pressure pad 6 includes a central portion 18 intermediate between the opposite side edges 8 of the pressure pad 6. In addition, the pressure pad 6 varies in thickness continuously, to be more thick toward the opposite side edges 8 from the central portion 18. In the embodiment, the engaged portion 18 comprises the central portion. The pressure imparting portion 20 comprises the more thick portion positioned between the central portion 18 and at least one of the opposite side edges 8.

Accordingly, the engaged portion 18 can be conveniently deformed along the outer surface of the cylinder 2 when pressed against the outer surface of the cylinder 2. The cleaning fabric 4 can be therefore sandwiched or nipped between the engaged portion 18 and the cylinder 2 with a nip width. The pressure imparting portion 20 imparts a pressure between the engaged portion 18 and the cylinder 2 so that the cleaning fabric 4 can be conveniently pressed against the outer surface of the cylinder 2 by the pressure pad 6 to clean the outer surface of the cylinder 2. Unlike the air pad disclosed in U.S. Pat. No. 4,344,361, the pressure pad 6 does not involves a source of air, piping, control of air and the like. The pressure pad 6 is simple in construction. It is not complicated and expensive.

In addition, the engaged portion 18 cooperates with the pressure imparting portion 20 to absorb the shock caused by the gap of the cylinder 2. The noise and vibration can be effectively decreased by the engaged portion 18 and the pressure imparting portion 20. It has been recognized in the apparatus that the noise and vibration can be effectively decreased to be acceptable not only when the cylinder 2 is rotated at a low speed of about 8 rpm but also when it is rotated at a high speed of about 70 rpm.

Figure 6:
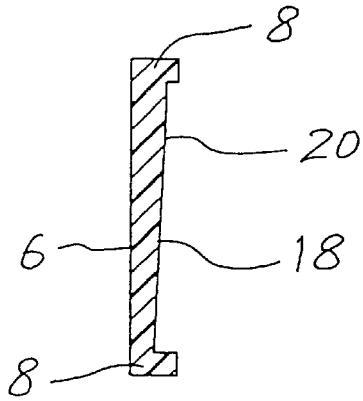
FIG. 6 is a sectional view of other embodiment.

The pressure pad 6 may varies in thickness continuously, to be more thick toward one of the opposite side edges 8 from the other side edge, as shown in FIG. 6. The pressure pad 6 is then curved between the opposite side edges 8 and fixed to the support bar 10, to be convex toward the outer surface of the cylinder. In the embodiment, the engaged portion 18 comprises a relatively thin portion spaced from the opposite side edges 8. The pressure imparting portion 20 comprises the more thick portion positioned between the relatively thin portion and one of the opposite side edges 8. Accordingly, the cleaning fabric 4 can be conveniently pressed against the outer surface of the cylinder 2 by the pressure pad 6, as in the embodiment of FIG. 5. The noise and vibration can be effectively decreased by the engaged portion 18 and the pressure imparting portion 20.

Figure 7:
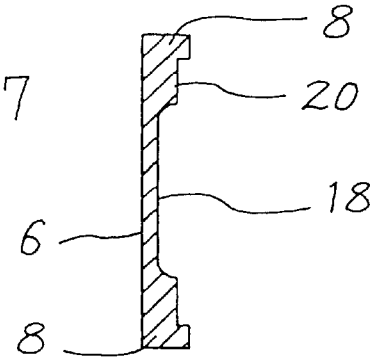
FIG. 7 is a sectional view of other embodiment.

In the embodiments of FIG. 5 and FIG. 6, the pressure pad 6 may vary in thickness discontinuously, as shown in FIG. 7.

The mechanical parameter may comprise the rigidness of the pressure pad 6. In the embodiment, the engaged portion 18 is relatively flexible. The pressure imparting portion 20 is relatively rigid to be different in rigidness from the engaged portion 18.

Figure 8:
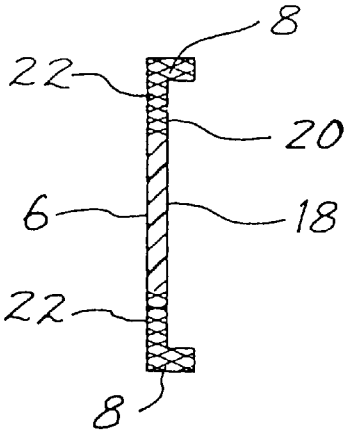
FIG. 8 is a sectional view of other embodiment.

For example, the pressure pad 6 is made of elastomer so that the engaged portion 18 is relatively flexible. The pressure imparting portion 20 includes fibers 22 incorporated thereinto to be relatively rigid, as shown in FIG. 8. Accordingly, the cleaning fabric 4 can be conveniently pressed against the outer surface of the cylinder 2 by the pressure pad 6, as in the embodiments of FIGS. 5 and 6. The noise and vibration can be effectively decreased by the engaged portion 18 and the pressure imparting portion 20.

The apparatus has been tested in a commercially available sheet-fed press to clean the outer surface of a cylinder having a length of 28 inches and a diameter of 200 mm. The cylinder has been rotated at a speed of 70 rpm. The cleaning fabric has included a vegetable oil previously impregnated thereinto. The cleaning fabric has been pressed against the outer surface of the cylinder with a nip width of 5 mm whenever intermittently fed. The cleaning fabric has been intermittently fed about ten times in one cleaning cycle to complete the cleaning. This is the same cleaning effect as the apparatus using the air pad.

As to the support bar 10 to which the opposite side edges 8 of the pressure pad 6 are fixed, the support bar 10 is required to be rigid so as not to amplify the noise and vibration of the pressure pad 6. In this connection, the support bar 10 comprises a metal plate which includes at least one bend formed by metal plate working such as bending or pressing. In the embodiment, the support bar 10 includes three bends 24, 26 and 28 formed by metal plate working to be channel shaped. The support bar 10 further includes end plates 30 disposed at the opposite ends thereof. The end plates 30 are fixed to the support bar 10 by welding and mounted on the side plates 12 by screws so that the support bar 10 is mounted indirectly on the side plate 12. Accordingly, the support bar 10 is reinforced by at least one bend 24, 26 and 28 formed by metal plate working so that the support bar 10 can be rigid so as not to amplify the noise and vibration of the pressure pad 6.

The apparatus further includes a supply of cleaning fabric 4 from which the cleaning fabric 4 is supplied to the pressure pad 6. In the embodiment, the supply of cleaning fabric 4 comprises a supply roll 32 including a core about which the cleaning fabric 4 is wound. The support bar 10 includes a pressure pad support portion 34 for supporting the pressure pad 6 and a supply roll support portion 36 bended from the pressure pad support portion 34. The supply roll 32 has an outer surface engaged with the supply roll support portion 36 to support the supply roll 32 for rotation. The cleaning fabric 4 is directed to the pressure pad 6 through the bend 28 of the support bar 10.

Figure 9:
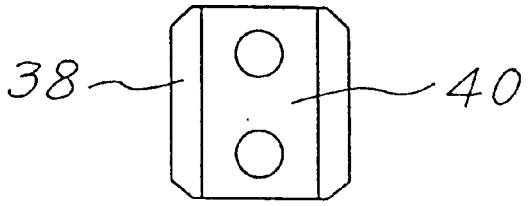
FIG. 9 is a side view of support means for supporting a supply of cleaning fabric of FIG. 1.
Figure 10:
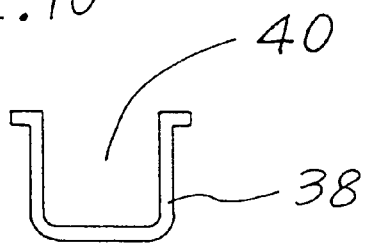
FIG. 10 is a bottom view of the support means of FIG. 9.

The apparatus further includes support means mounted on the side plates 12 for supporting the supply of cleaning fabric 4 comprising the supply roll 32. The support means comprises metal plates 38 mounted on the end plates 30 by screws so that the metal plates 38 are integrally fixed to the support bar 10 to be mounted indirectly on the side plates 12. The supply roll 32 includes projections projecting from the opposite end surfaces of the supply roll 32. The metal plates 38 are shaped by metal plate working such as bending or pressing to include slots 40, as shown in FIG. 9 and FIG. 10, into which the projections are received for movement in accordance with the decrease in diameter of the supply roll 32.

The apparatus further includes a movable member comprising a rotatable roller 42 which is mounted on an arm 44 fixed to a shaft 46. The roller 42 is engaged with the outer surface of the supply roll 32. The apparatus further includes resiliently urging means comprising springs 48 which are disposed around the shaft 46 and engaged with the arm 44 as shown in FIG. 4, for resiliently urging the arm 44 and the roller 42 to move the roller 42 in accordance with the decrease in diameter of the supply roll 32. The roller 42 cooperates with the springs 48 to prevent the supply roll 32 from bouncing.

A take-up shaft 50 extends between the side plates 12 to be mounted on the side plates 12 for removal. The cleaning fabric 4 is directed to the take-up shaft 50 through the pressure pad 6 and a sleeve 52 which is fitted onto the shaft 46 of the arm 44. In the embodiment, the take-up shaft 50 includes rectangular plugs 54 and 56 protruding from the opposite ends thereof and fitted into sockets which are formed in rotating and support shafts 58 and 60 mounted on the side plates 12. The plug 56 is resiliently urged by a spring to protrude from one end of the take-up shaft 50, the spring being received in the take-up shaft 50. Accordingly, the plug 56 can be retracted into the take-up shaft 50 against the spring when the take-up shaft 50 is moved toward the support shaft 60. The plug 54 is therefore disengaged from the socket in the rotating shaft 58 so that the take-up shaft 50 can be removed from the rotating and support shafts 58 and 60 and the side plates 12.

Figure 2:
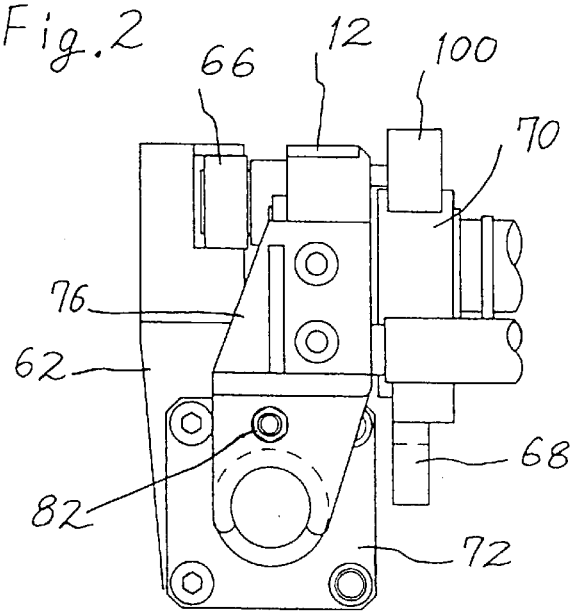
FIG. 2 is an elevational view of the apparatus of FIG. 1.
Figure 3:
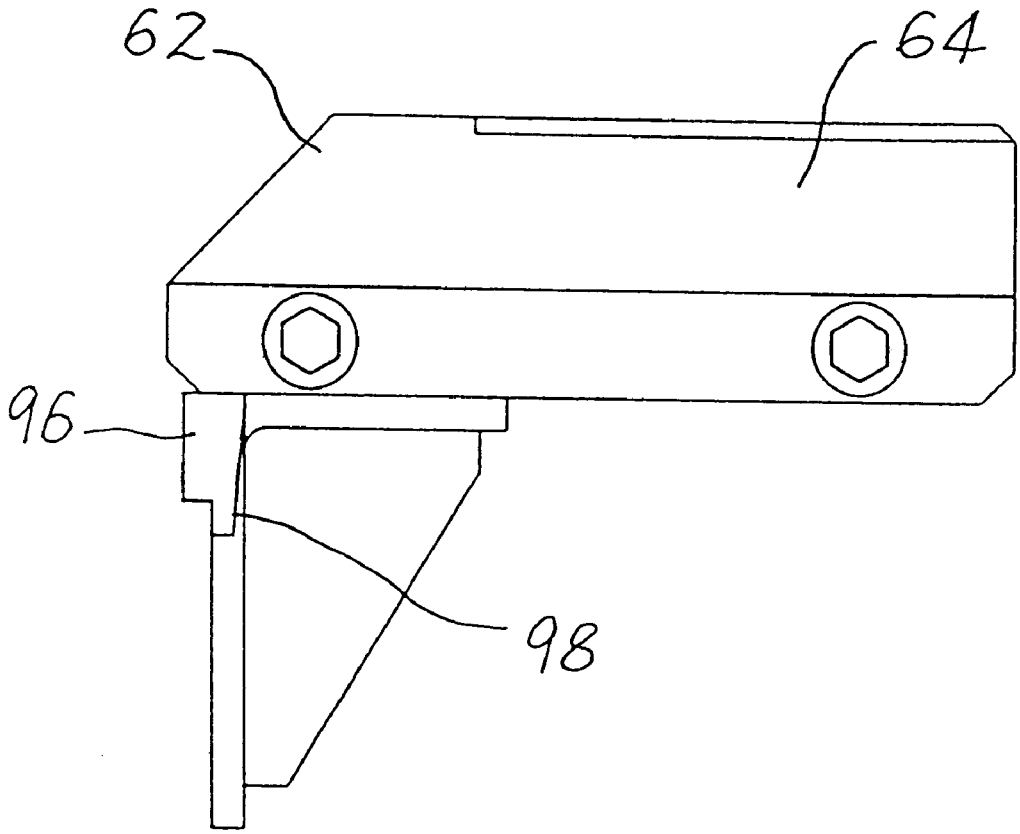
FIG. 3 is a plan view of the adapter plate of FIG. 1.

The apparatus further includes first drive means for rotating the take-up shaft 50 to take-up the cleaning fabric 4 about the take-up shaft 50. The apparatus further includes adapter means comprising adapter plates 62 which are mounted on fixed frame means. The adapter plates 62 include guide means comprising guide rails 64 for supporting and guiding the side plates 12 for movement toward and from the cylinder 2, as shown in FIG. 2 and FIG. 3. The side plates 12 includes rollers 66 mounted thereon and engaged with the guide rails 64. The apparatus further includes second drive means connected directly or indirectly to the side plates 12 for moving the side plates 12 along the guide rails 64 toward and from the cylinder 2 so that the cleaning fabric 4 can be pressed against and retracted from the cylinder 2.

Figure 11:
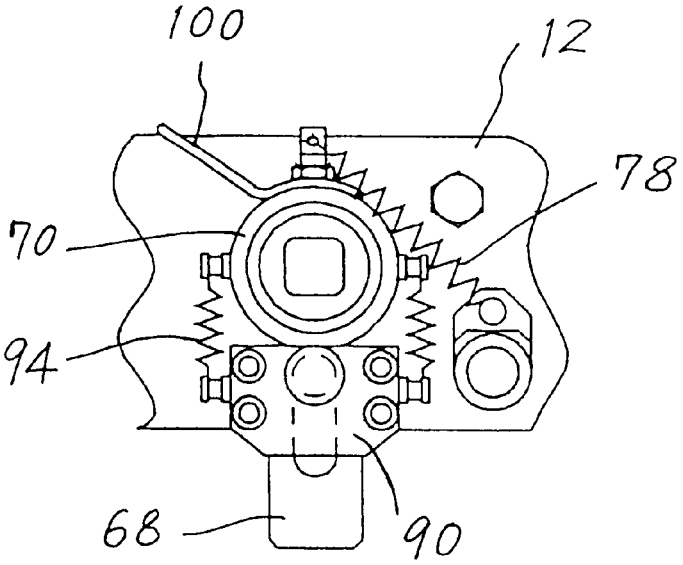
FIG. 11 is a side view of the take-up shaft of FIG. 1, showing springs.

In the embodiment, the first drive means comprises a lever 68 formed on a ring 70 which is disposed around the take-up shaft 50. The ring 70 is connected to the take-up shaft 50 through a one-way clutch. On the other hand, the second drive means comprises an air cylinder 72 mounted on the adapter plates 62. The air cylinder 72 includes a piston rod 74 fitted thereinto and connected to the side plates 12 through a connecting member 76 for moving the side plates 12 along the guide rails 64 toward and from the cylinder 2. The lever 68 is engaged with the air cylinder 72 to rotate the take-up shaft 50 through the ring 70 and the one-way clutch in response to the air cylinder 72 moving the side plates 12 by which the cleaning fabric 4 is pressed against and retracted from the cylinder 2. A spring 78 is provided for resiliently urging the ring 70 and the lever 68 to rotate them reversely to the original angular position, as shown in FIG. 11. This takes-up the cleaning fabric 4 about the take-up shaft 50 so that the cleaning fabric 4 can be intermittently supplied or fed to the pressure pad 6.

Figure 12:
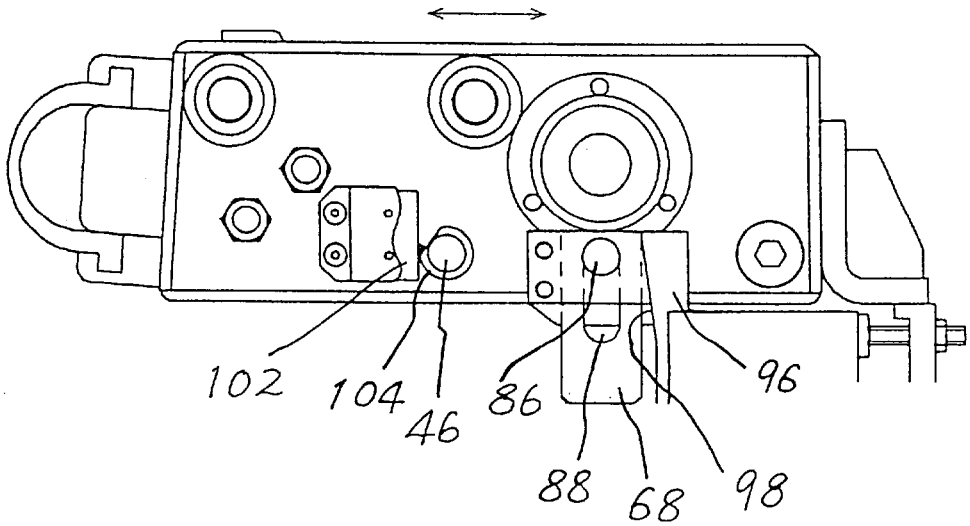
FIG. 12 is a side view of the arrangement for detecting the residue of cleaning fabric of FIG. 1.

A stop 80 is formed on one end of a bolt 82 which is threadedly engaged with the connecting member 76 so that the stop 80 can be engaged with the air cylinder 72 to stop the side plates 12. The stop 80 can be moved by turning the bolt 82 to adjust the stroke of the side plates 12 and the pressure between the pressure pad 6 and the cylinder 2. A roller 84 is mounted on a pin 86 which is inserted into a slot 88 formed in the lever 68, as shown in FIG. 12. The pin 86 is mounted on a block 90 and a mounting plate 92 for movement along the slot 88. Springs 94 are engaged with the block 90 for resiliently urging the block 90, the pin 86 and the roller 84 so that the roller 84 can be engaged with the cleaning fabric 4 on the take-up shaft 50. A cam member 96 includes a cam surface 98 formed thereon to be opposed to the pin 86. The pin 86 is engaged with the cam surface 98 to restrict the rotation of the take-up shaft 50. This can takes-up-the cleaning fabric 4 for a length at a time regardless of the diameter of the cleaning fabric 4 on the take-up shaft 50.

In addition, a handle 100 is fixed to the ring 70 to be connected to the take-up shaft 50 through the one-way clutch. The handle 100 is intended to manually rotate the take-up shaft 50 an angle at a time so that the cleaning fabric 4 can be strained by the take-up shaft 50 before starting the cleaning. The apparatus further includes a switch 102 for detecting the residue of cleaning fabric 4 on the supply roll 32. A cam member 104 is mounted on one end of the shaft 46 for cooperating with the roller 42 and the arm 44 to actuate the switch 102, detecting the residue of cleaning fabric 4.

In the apparatus, it is required to remove the assembly including the support bar 10, the side plates 12 and the like from adapter plates 62 which are mounted on fixed frame means, occasionally for maintenance. It is also required to then set again the assembly on the adapter plates 62. By the way, the support bar 10 is shaped by metal plate working such as bending or pressing, as described above. Accordingly, unlike the support bar in the prior art which is machined to be rigid, the support bar 10 is relatively light. The side plates 12 are also shaped by metal plate working such as bending or pressing, as described above, to be relatively light. It is therefore easy to remove and then set again the assembly including the support bar 10, the side plates 12 and the like without taking labour and time.

In the apparatus of FIG. 1, the cleaning fabric 4 is supplied to the pressure pad 6 from the supply roll 32 downwardly. The apparatus may be arranged that the cleaning fabric 4 is supplied to the pressure pad 6 from the supply roll 32 upwardly, as shown in FIG. 13.

Figure 13:
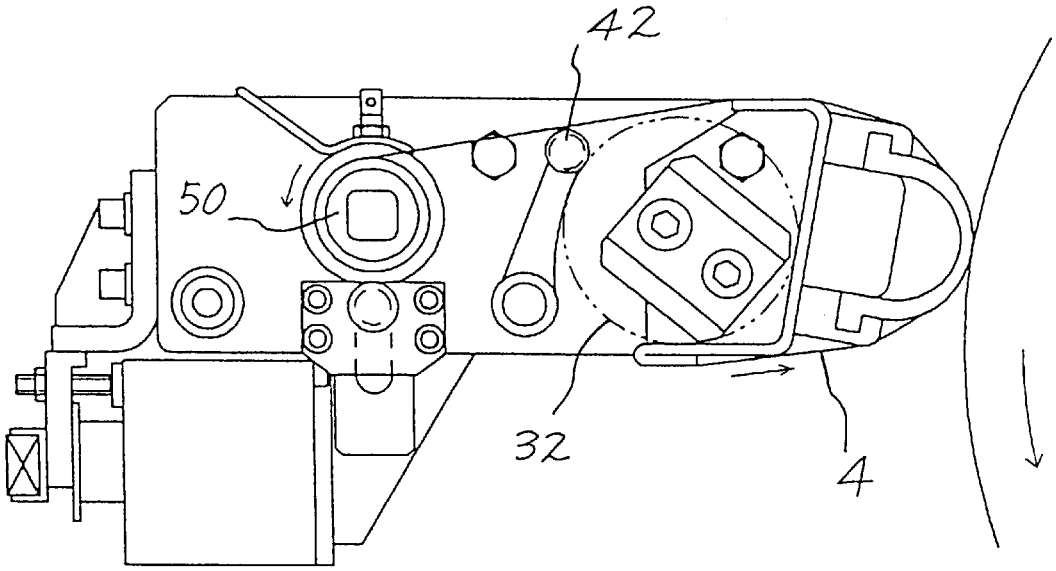
FIG. 13 is a side view of other embodiment.

In the apparatus of FIG. 1 or FIG. 13, the pressure pad 6 may comprise an air pad, a sponge pad or an elastomer pad having a constant thickness.

The apparatus may includes a supply of cleaning fabric 4 such as a cassette for receiving a cleaning fabric 4 which is folded. The support bar 10 may comprises a metal plate which includes at least one bend formed by metal plate working such as bending or pressing to be any shaped other than channel shaped. The support bar 10 may be reinforced by not only the bend but also at least one rib extending longitudinally of the support bar 10 or side plates 12. The support bar 10 may be mounted directly on the side plates 12 without the end plates 30. The apparatus may include first drive means other than the lever 68 and the air cylinder 72. For example, the first drive means may comprise a motor, reduction gears, cam means or the like for rotating the take-up shaft 50 to take-up the cleaning fabric 4 about the take-up shaft 50.

What is claimed is:

1. An apparatus for cleaning an outer surface of a cylinder with a cleaning fabric, said cleaning fabric being directed between a pressure pad and said cylinder so that said cleaning fabric can be pressed against said outer surface of the cylinder by said pressure pad to clean said outer surface of the cylinder, said apparatus comprising:

a pair of side plates spaced from and opposed to each other; and a support bar extending between said side plates to be mounted directly or indirectly on said side plates for supporting said pressure pad, said support bar comprising a metal plate which includes a first planar portion, a second planar portion which defines a pressure pad support portion perpendicularly extending from the first portion and which faces the cylinder, a first bend being formed by metal plate working between said first and second planar portions, and a third planar portion perpendicularly extending from the second portion in a direction away from the cylinder, a second bend being formed by metal plate working between said second and third planar portions, said first, second, and third planar portions defining a space behind said second planar portion and between said first and third planar portions and utilized for installing a supply roll from which said cleaning fabric is supplied.

2. The apparatus as set forth in claim 1 further comprising:

a supply of cleaning fabric from which said cleaning fabric is supplied to said pressure pad;

support means mounted on said side plates for supporting said supply of cleaning fabric;

a take-up shaft extending between said side plates to be mounted on said side plates for removal, said cleaning fabric is directed to said take-up shaft through said pressure pad;

first drive means for rotating said take-up shaft to take-up said cleaning fabric about said take-up shaft;

adapter plate means mounted on fixed frame means and including guide means for supporting and guiding said side plates for movement toward and from said cylinder; and second drive means connected directly or indirectly to said side plates for moving said side plates along said guide means toward and from said cylinder so that said cleaning fabric can be pressed against and retracted from said cylinder.

3. The apparatus as set forth in claim 1 or 2 wherein said pressure pad has opposite side edges fixed to said support bar to extend parallel to said cylinder, said pressure pad being made of elastomer and curved between said opposite side edges thereof to be convex toward said outer surface of the cylinder, said pressure pad cooperating with said cleaning fabric so that said cleaning fabric can be pressed against said outer surface of the cylinder by said pressure pad to clean said outer surface of the cylinder, said pressure pad comprising:

an engaged portion engaged with said cleaning fabric so that said cleaning fabric is sandwiched between said engaged portion and said cylinder to be pressed against said outer surface of the cylinder; and a pressure imparting portion positioned between said engaged portion and at least one of said opposite side edges of the pressure pad for imparting a pressure between said engaged portion and said cylinder, said pressure imparting portion being different in thickness from said engaged portion.

4. The apparatus as set forth in claim 1 or 2 wherein said pressure pad has opposite side edges fixed to said support bar to extend parallel to said cylinder, said pressure pad being made of elastomer and curved between said opposite side edges thereof to be convex toward said outer surface of the cylinder, said pressure pad cooperating with said cleaning fabric so that said cleaning fabric can be pressed against said outer surface of the cylinder by said pressure pad to clean said outer surface of the cylinder, said pressure pad comprising:

an engaged portion engaged with said cleaning fabric so that said cleaning fabric is sandwiched between said engaged portion and said cylinder to be pressed against said outer surface of the cylinder; and a pressure imparting portion positioned between said engaged portion and at least one of said opposite side edges of the pressure pad for imparting a pressure between said engaged portion and said cylinder, said pressure imparting portion being different in rigidness from said engaged portion.

5. The apparatus as set forth in claim 1 or 2 wherein said pressure pad comprises an air pad, a sponge pad or an elastomer pad having a constant thickness.

6. The apparatus as set forth in claim 2 wherein said supply of cleaning fabric comprises a supply roll including a core about which said cleaning fabric is wound, said supply roll further including projections projecting from the opposite end surfaces of said supply roll, said support means comprising metal plates shaped by metal plate working to include slots into which said projections are received for movement in accordance with the decrease in diameter of said supply roll.

7. The apparatus as set forth in claim 6 wherein said support means is integrally fixed to said support bar to be mounted indirectly on said side plates.

8. The apparatus as set forth in claim 6 wherein said first portion of said metal plate defines a supply roll support portion, said supply roll having an outer surface engaged with said supply roll support portion to support said supply roll for rotation.

9. The apparatus as set forth in claim 8 further comprising:

a movable member engaged with said outer surface of the supply roll; and resiliently urging means for resiliently urging said movable member to move it in accordance with the decrease in diameter of said supply roll.

10. The apparatus as set forth in claim 2 wherein said first drive means rotates said take-up shaft in response to said second drive means moving said side plates by which said cleaning fabric is pressed against and retracted from said cylinder.

11. The apparatus as set forth in claim 2 wherein said first drive means comprises a handle connected to said take-up shaft through a one-way clutch to manually rotate said take-up shaft an angle at a time.

12. The apparatus as set forth in claim 1 wherein said metal plate further includes a fourth planar portion extending from the third portion parallel to and abutting the third portion, a third bend being formed by metal plate working between said third and fourth planar portions.

* * * * *